United States Patent [19]

Granzow et al.

[11] Patent Number: 4,530,226

[45] Date of Patent: Jul. 23, 1985

[54] SWEEP-FORMING APPARATUS

[75] Inventors: Carl F. Granzow, Royal Oak; Edward G. Lash, Huntington Woods; Everett Gleason, South Lyon; Jerome Kubiak, Troy, all of Mich.

[73] Assignee: Tishken Products, Inc., Oak Park, Mich.

[21] Appl. No.: 503,405

[22] Filed: Jun. 13, 1983

[51] Int. Cl.[3] ..... B21D 7/08

[52] U.S. Cl. ..... 72/171; 72/170; 72/168; 72/176

[58] Field of Search ..... 72/168, 166, 169–174, 72/176, 182, 466, 465

[56] References Cited

U.S. PATENT DOCUMENTS

| | | | |
|---|---|---|---|
| 520,865 | 6/1894 | Ryding | 72/166 |
| 592,767 | 11/1897 | Einfeldt | 72/168 |
| 1,351,472 | 8/1920 | Farmer | 72/171 |
| 1,856,597 | 5/1932 | Stjarnstrom | 72/466 |
| 1,908,373 | 5/1933 | Loepsinger | 72/166 |
| 2,143,442 | 1/1939 | Kellogg | 72/166 |
| 2,150,731 | 3/1939 | Smith . | |
| 2,701,002 | 2/1955 | Arbogast | 72/166 |
| 3,144,071 | 8/1964 | Nash | 72/166 |
| 3,473,361 | 10/1969 | Cwik . | |
| 3,490,259 | 1/1970 | Cwik . | |
| 3,491,562 | 1/1970 | Kajiwara . | |
| 3,491,569 | 1/1970 | Sabirov . | |
| 3,529,461 | 9/1970 | Knudson . | |
| 3,610,011 | 10/1971 | Valentine . | |
| 3,842,473 | 10/1974 | Couper | 72/166 |
| 3,938,360 | 2/1976 | Shida et al. | 72/8 |
| 4,080,815 | 3/1978 | Foster | 72/168 |
| 4,117,702 | 10/1978 | Foster | 72/173 |
| 4,123,930 | 11/1978 | Hill et al. | 72/466 |
| 4,154,077 | 5/1979 | Cotter | 72/166 |
| 4,176,539 | 12/1979 | Sawada et al. | 72/178 |
| 4,273,232 | 6/1981 | Saito et al. | 72/701 |
| 4,354,372 | 10/1982 | Inoue et al. | 72/177 |

FOREIGN PATENT DOCUMENTS

| | | | |
|---|---|---|---|
| 453623 | 9/1936 | United Kingdom | 72/166 |
| 898664 | 6/1962 | United Kingdom | 72/166 |
| 617112 | 7/1978 | U.S.S.R. | 72/166 |

OTHER PUBLICATIONS

"Suppliers Play Big Role in Roll-Formed Bumpers'-'—Ward's Auto World 7/82.

"HSLA Bumpers From a Rollformer"—American Machinist, Aug. 1982.

"Hitachi Cold Roll Forming Lines"—Hitachi Metals, Ltd.

*Primary Examiner*—Daniel C. Crane

*Attorney, Agent, or Firm*—Harness, Dickey & Pierce

[57] ABSTRACT

An apparatus and associated method is disclosed for introducing a curvature or sweep into a preferably previously-formed elongated article. The elongated article is substantially constrained, both laterally and transversely, as it moves longitudinally through the sweep-forming apparatus and is permanently deformed in a transverse direction in order to introduce the sweep or curvature therein.

11 Claims, 11 Drawing Figures

SWEEP-FORMING APPARATUS

BACKGROUND AND SUMMARY OF THE INVENTION

The invention relates generally to a method and apparatus for forming sheet material, such as sheet metal, into an article having a desired configuration and cross-sectional shape. More particularly, the invention relates to methods and apparatus for roll-forming a sweep or curvature into such article.

In conventional cold roll-forming methods and apparatus, a flat strip of sheet material, such as sheet metal or the like, is longitudinally passed between a series of corresponding forming rolls that progressively deform the sheet material into a desired configuration and cross-sectional shape. Although such methods and apparatus have become well-developed over the years, and have proved to be quite successful and advantageous in cold-forming a wide variety of articles and products, they have previously been very limited in their capability to form article configurations having a longitudinal sweep or curvature. Such methods and apparatus have been especially incapable of sweep-forming curved configurations from various high-strength, light weight materials, such as high-strength, low alloy (HSLA) steel. Such materials are very desirable for the fabrication of products such as automotive bumpers, for example. Because of the difficulty or infeasibility of sweep-forming such materials, products that require a sweep or curvature have previously been formed by other conventional techniques, such as by stamping, stretch-forming, or extruding and have thus been expensive and difficult to accomplish efficiently.

According to the present invention, sweep-forming apparatus, which is preferably located at the end of a roll-forming line, generally includes a base assembly and one or more forming stations serially-disposed in a longitudinal direction and adapted to introduce a sweep or curvature into a previously-formed elongated article. At least one of such forming stations preferably includes transversely off-set forming rolls for permanently deforming the elongated article in a transverse direction and apparatus for substantially constraining substantially all of the lateral and transverse surfaces of the previously-formed article during the introduction of a sweep therein without introducing undesirable wrinkles, folds or other undesirable deformations into the article. Preferably, the transverse position of each forming station is adjustable in order to progressively displace successive forming stations farther in the transverse direction from the base assembly and thereby accommodate various degrees of sweep in varying applications.

Additional advantages and features of the present invention will become apparent from the following description and the appended claims, taken in conjunction with the accompanying drawings.

BRIEF DESCRIPTION OF THE DRAWINGS

FIG. 3 is a partial cross-sectional perspective view ( the automotive bumper of FIG. 2.

DETAILED DESCRIPTION OF THE PREFERRED EMBODIMENTS

FIGS. 1 through 11 of the drawings depict, for pur poses of illustration, an exemplary roll-forming line including sweep-forming apparatus according to th present invention. One skilled in the art will readil recognize from the following discussion that the princi ples of the present invention are equally applicable t roll-forming equipment other than that shown in th drawings.

Figure 1:
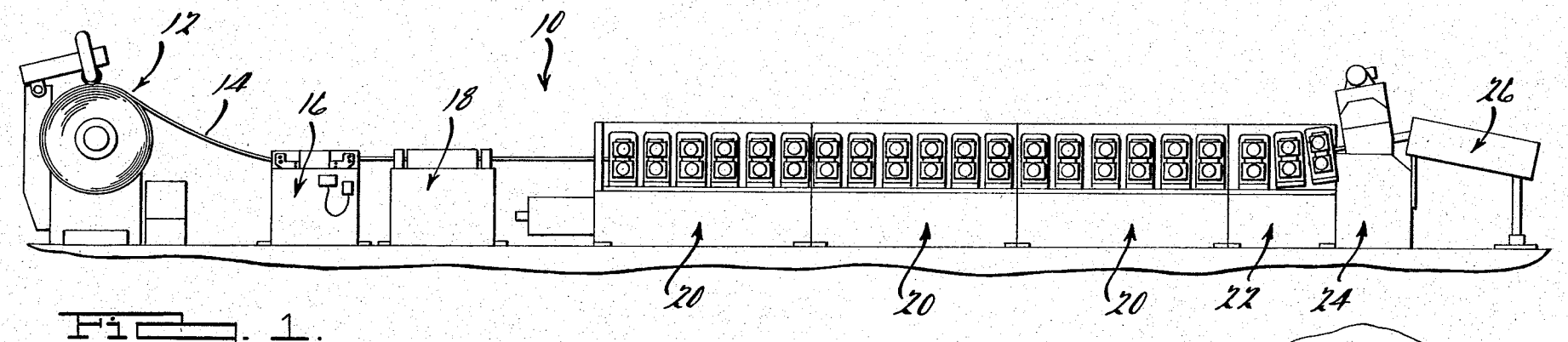
FIG. 1 is a side elevation view of a roll-forming apparatus, including sweep-forming apparatus according to the present invention.

Referring to FIG. 1, an exemplary roll-forming lin 10, generally includes a coil holder 12 for dispensing coiled strip of sheet material 14, a feeding and levelin apparatus 16, and an end-welder machine 18 for longitu dinally feeding the sheet material 14 into one or mor roll-forming sections 20. The roll-forming sections 2 each include a number of serially-located sets of form ing rolls (not shown) that progressively deform th sheet material 14 as it is longitudinally fed therethrougl in order to ultimately form the sheet material into desired configuration and cross-sectional shape. Ac cording to the present invention, the roll-forming lin 10 includes a sweep-forming apparatus 22, preferabl located at the end or exit of the series of roll-formin sections 20. The sweep-forming apparatus 22 functions as is described further below, to introduce a generall longitudinally-extending sweep or curvature into th previously-formed sheet material 14. Typically, th roll-forming line 10 may also include an automatic cut off machine 24 and a conveyor mechanism 26 for trans porting the finished product to another location in th fabricating facility.

Figure 2:
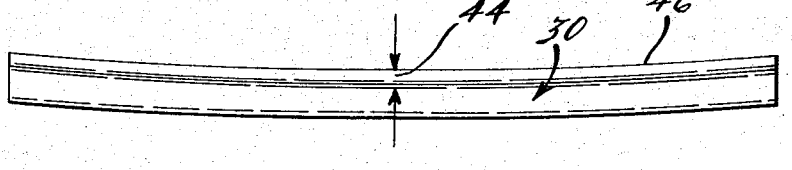
FIG. 2 is a top view of an exemplary arcuate automotive bumper, illustrating one type of article which may be formed by the roll-forming apparatus of FIG. 1.

FIGS. 2 and 3 illustrate, for purposes of illustratior only, a longitudinally-extending automotive bumper 3 which exemplifies one type of product which may b formed or fabricated on equipment such as the roll forming line 10 having a sweep-forming apparatus 2 according to the present invention. The exemplary au tomotive bumper 30 is generally U-shaped and include an upper portion 32, an outer portion 34, and a lowe portion 36. Typically, a pair of flanges 38 and 40 pro trude inwardly toward each other from the upper and lower portions 32 and 36, respectively. As described herein with respect to the roll-forming line 10 and the sweepforming apparatus 22, both the interior and exterior surfaces of the outer portion 34 and the flanges 38 and 40 are referred to as "lateral" or "laterally-extending" surfaces. Correspondingly, both the interior and exterior surfaces of the upper and lower portions 32 and 36 are referred to as "transverse" or "transversely-extending" surfaces.

In one embodiment of the present invention, automotive bumpers such as that depicted by reference number 30 in FIGS. 2 and 3, were fabricated from high-strength, low-alloy (HSLA) steel having a yield strength in the range of approximately 45,000 p.s.i. to approximately 200,000 p.s.i., with a degree of curvature or sweep up to approximately "no. 30" sweep. The "sweep number" refers to the relationship of the chord depth 44 shown in FIG. 2, to the overall length of the chord 46. For example, a "no. 10 sweep" refers to a maximum chord depth of ten-eighths (10/8") inch over a five-foot increment of chord length. It was found during the actual development and construction of a sweep-forming apparatus according to the present invention that such degrees of curvature could be introduced into elongated, high-strength, low-alloy steel articles that have already been formed into their final desired cross-sectional shapes without affecting or damaging the previously-formed cross-sectional shape of the article.

Figure 4:
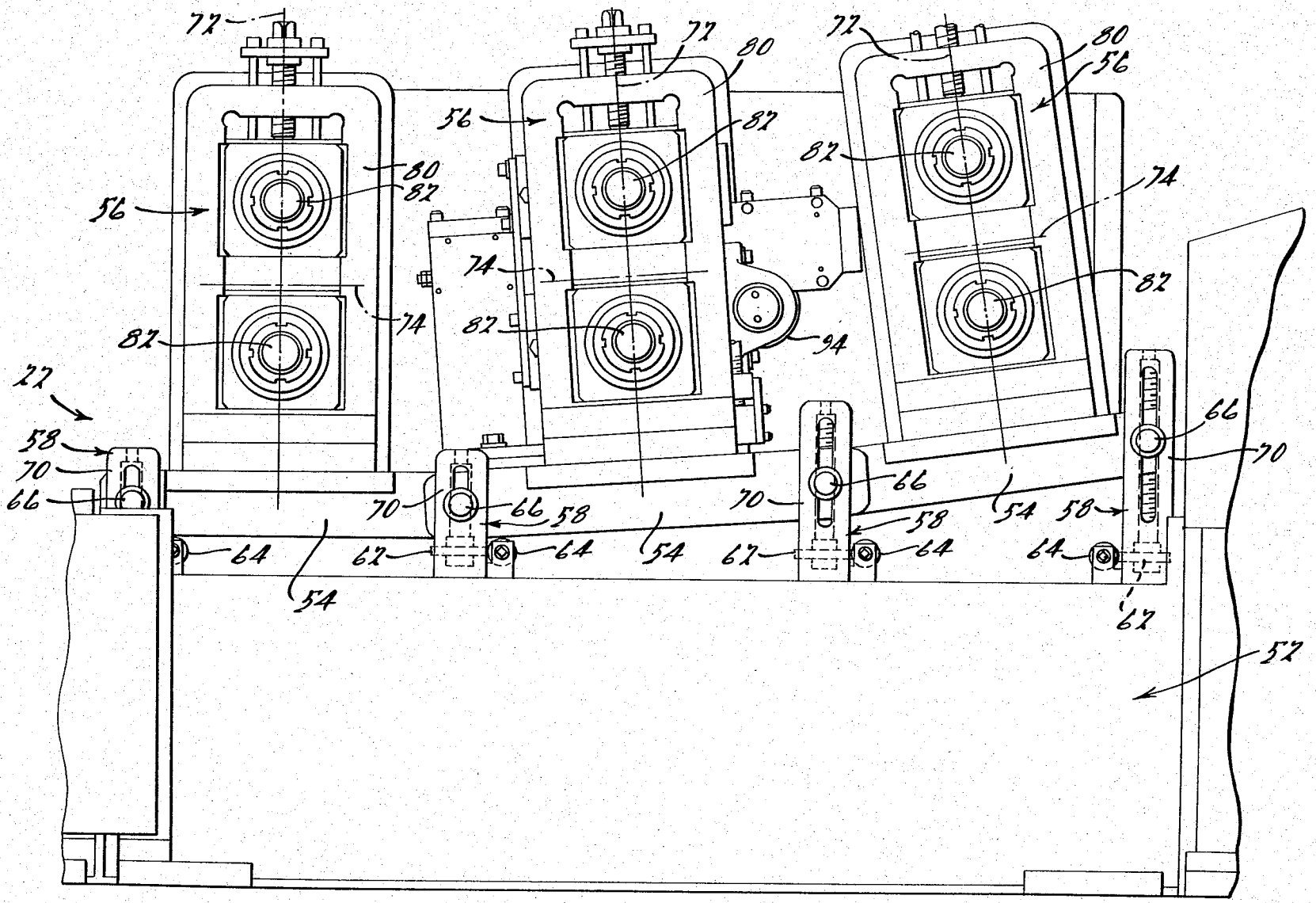
FIG. 4 is an enlarged side elevation view of th sweep-forming apparatus of FIG. 1.

FIG. 4 illustrates an enlarged side elevational view of the exemplary sweep-forming apparatus 22, which generally includes a base assembly 52, a number of articulated and pivotally interconnected support platforms 54, and a corresponding number of forming station assemblies 56 supportably secured to the support platforms 54. It should be noted that although three forming stations are depicted for purposes of illustration in the exemplary sweep-forming apparatus 22, a greater or lesser number of forming stations may alternatively be employed in a particular application. As will become apparent from the discussion herein, the exact number of forming stations depends upon various factors, such as the degree of curvature or sweep to be introduced into the formed elongated article, the type of material being formed, and the cross-sectional shape of the article, for example.

Figure 6:
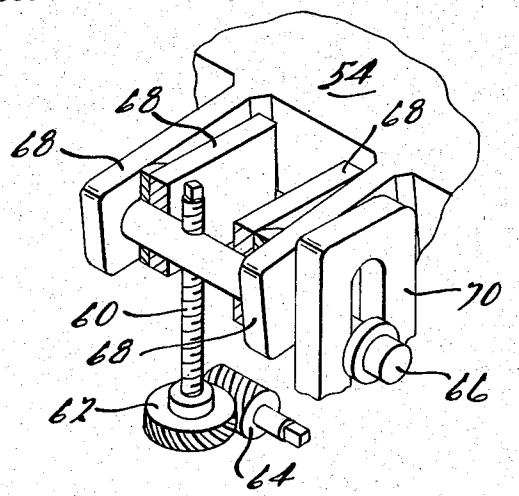
FIG. 6 is a partial perspective view of the suppo platform structure of FIG. 5, diagramatically illustra ing a mechanism for selectively adjusting the transvers position of the sweep-forming stations of FIG. 5 in transverse direction generally perpendicular to the lor gitudinal path of the workpiece.
Figure 7:
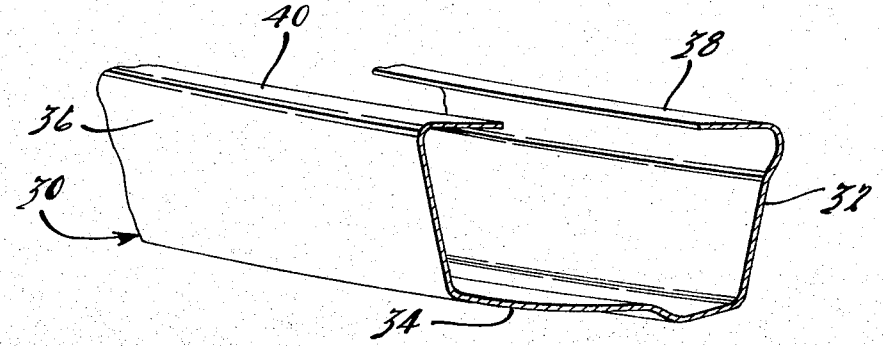
FIG. 7 is an enlarged side elevation view of one of th stations of the sweep apparatus of FIG. 4, with one of it supporting stands removed to reveal the various form ing components therein.
Figure 5:
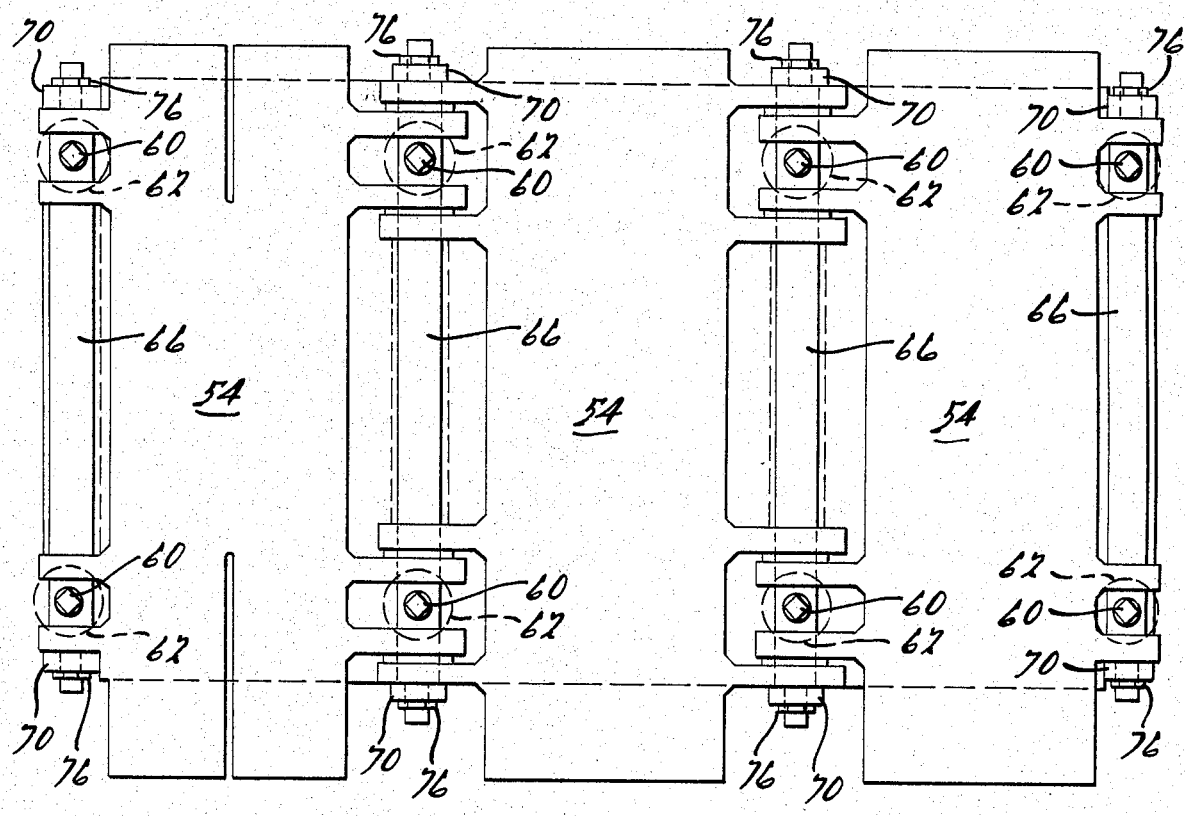
FIG. 5 is a plan view of the support platform portior of the sweep-forming apparatus of FIG. 4.

The position of the support platforms 54 relative to the base assembly 52 can preferably be adjustably increased or decreased in a transverse direction, and the platforms can be rotated relative to the base assembly 52 in order to form the desired degree of sweep in the elongated article. Such adjustments are facilitated in the preferred embodiment by a number of adjustment mechanisms 58 provided at both lateral sides and at both longitudinal ends of each support platform 54. As illustrated in FIGS. 5 and 6, the adjustment mechanisms 58 each generally include a generally transversely-extending threaded adjusting screw 60 fixed for rotation with a worm wheel 62 meshed with, and rotatably driven by, a worm gear 64. The adjusting screws 60 are threadably engaged with each end of a number of anchor bars 66. Each anchor bar 66 extends laterally through generally circular openings in a number of longitudinally-extending arms 68 on adjacent support platforms 54 and through elongated openings in a lock bracket 70 at each of its lateral ends.

As the adjusting screws 60 are rotated by the interaction of their associated worm gears 64 and worm wheels 62, they threadably urge the anchor bars 66 in a transverse direction toward or away from the base assembly 52. The support platforms 54, which are pivotally connected to the anchor bars 66 by way of their longitudinally-extending arms 68, are therefore also moved toward or away from the base assembly 52 in order to adjust the transverse position of the forming station assemblies 56 for the desired degree of sweep or curvature in the item being formed. As shown in FIG. 4, by adjusting the transverse position of the anchor bars 66, the center line 72 of each forming station 56 can be maintained in a generally perpendicular relationship with the tangential path 74 of the workpiece as it is passed longitudinally through the forming station. Once the above-described adjustments are made, the adjustment mechanisms 58 are secured to the base assembly 52 by locking bolts or other suitable securing means, and the anchor bars 66 are secured to the lock bracket 70 by locking nuts 76 or other suitable locking means, in order to maintain the support platforms 54 in their adjusted positions.

It should be noted the corresponding adjustment mechanisms 58 at each end of an anchor bar may optionally be interconnected by a common drive shaft drivingly interconnecting their respective worm gears 64 in order to simultaneously adjust the position of both lateral ends of their associated anchor bars by the same amount. Alternatively, such adjustments may optionally be driven by independent worm gears at each lateral end of each anchor bar in order to accommodate unusual forming conditions necessitating independent lateral adjustment capabilities.

Generally, each forming station 56 at least includes a pair of laterally-spaced corresponding stand assemblies 80 adapted for supporting one or more driven roll shafts 82 that drivingly carry forming rolls (described below) that conformingly engage opposite lateral surfaces of the previously-formed bumper 30 therebetween. The stand assemblies 80, as well as other components of forming stations 56, are connected with their respective support platforms 54 and thus may also be adjustably pivoted and transversely moved therewith.

For purposes of illustration, FIGS. 7 through 11 generally depict the various sweep-forming components of the intermediate, or second, of the three sweep-forming stations 56 of the exemplary sweep-forming apparatus 22. The sweep-forming station 56 generally includes a pair of corresponding forming rolls 84 and 86 mounted on the roll shafts 82 for rotation therewith, an entrance-side constraining assembly 90 secured to the stand assembly 80 at the entrance side of the sweep-forming station, and a transversely and longitudinally offset forming roll 94 mounted on the exit-side of the constraining assembly 92. It should be noted that the workpiece is preferably driven in a longitudinal direction by the forming rolls 84 and 86, which conformingly engage opposite lateral surfaces of the bumper outer portion 34.

Figure 8:
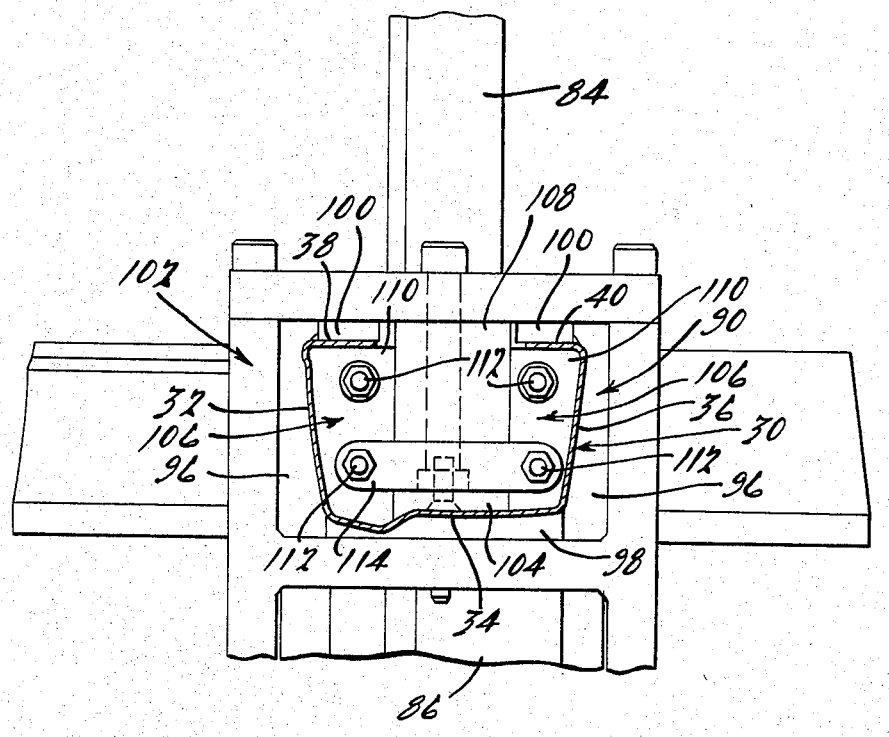
FIG. 8 is a partial end view of the entrance of th sweepforming station of FIG. 7, with various compc nents removed for clarity.
Figure 7:
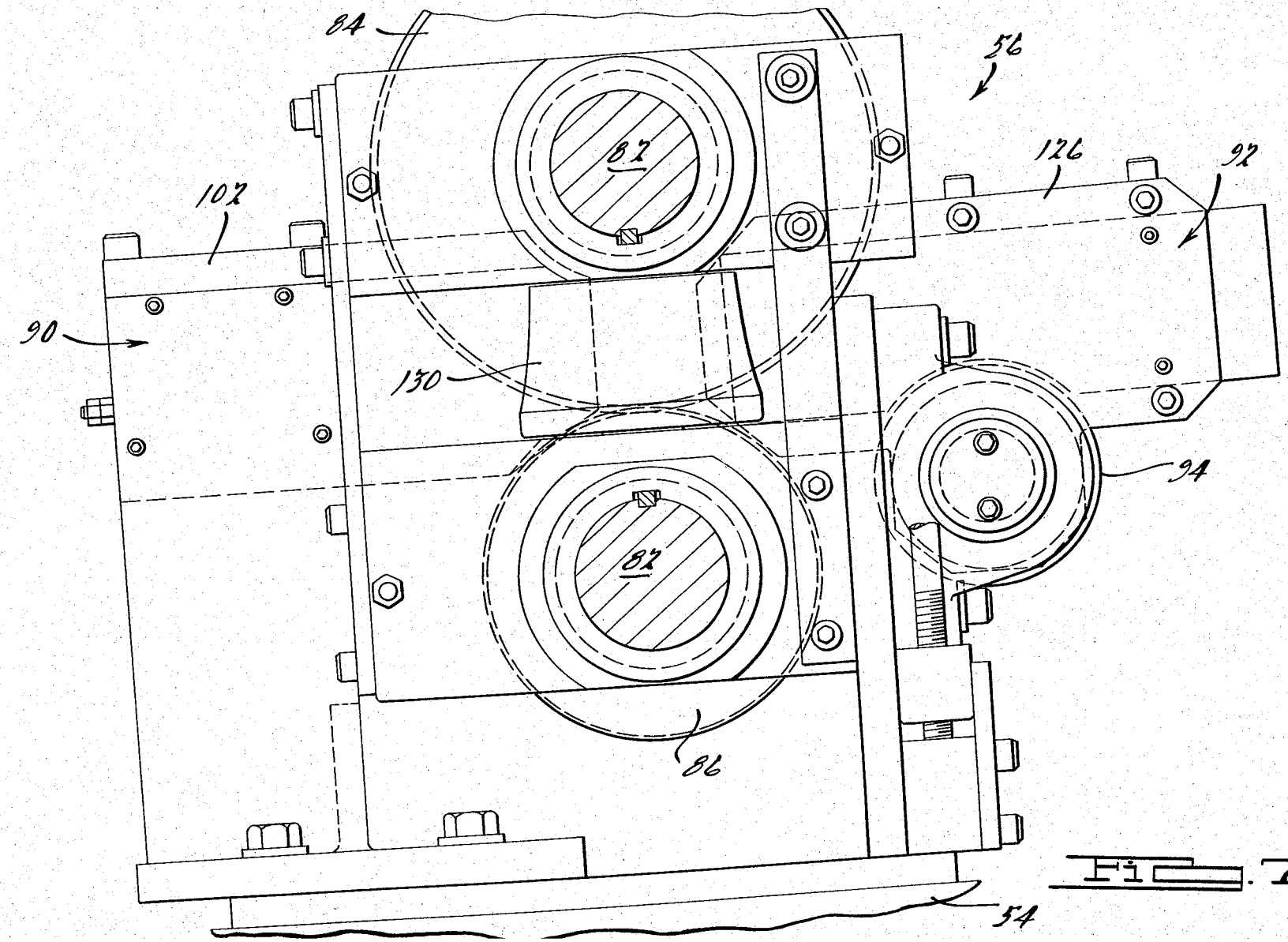

As shown in FIG. 8, the longitudinally-moving elongated workpiece (here the bumper 30) enters the constraining assembly 90 and is substantially constrained in its desired cross-sectional configuration during the sweep-forming operation. A pair of suitably-shaped outside arbors 96 slidably and conformingly engage the exterior transverse surfaces of the portions 32 and 36 of the bumper 30, a back-up shoe 98 slidably and conformingly engages the exterior lateral surface of the bumper portion 34, and a pair of constraining arbors 100 slidably and conformingly engage the exterior lateral surfaces of bumper flanges 38 and 40, in order to constrain substantially all of the entire exterior lateral and transverse surfaces of the bumper 30. The outside arbors 96, back-up shoe 98, and the constraining arbors 100 are all connected to a fixed body portion 102 of the constraining assembly 90. In the preferred embodiment, the interior surfaces of the bumper 30 are constrained by a suitably-shaped insert member 104 and a pair of articulated interior or "snake" arbors 106 that slidably engage the interior surfaces of the bumper 30. The insert member 104 is secured to a guide block 108, which is in turn secured to the fixed body portion 102. The snake arbors 106 each include a number of specially-shaped arbor blocks 110 that are longitudinally interconnected by at least one tie rod 112 that is anchored to the guide block 108 by a retainer plate 114.

Figure 9:
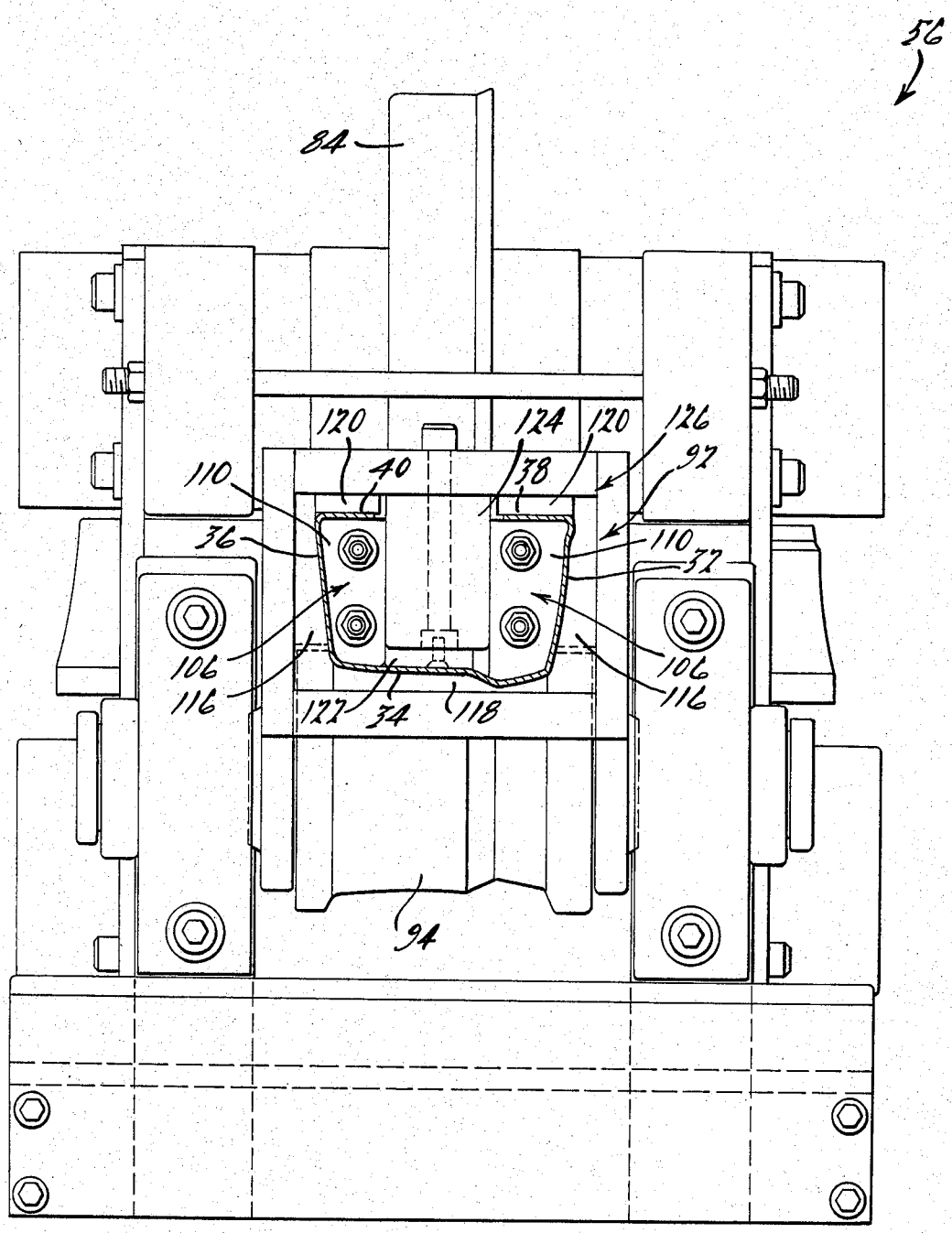
FIG. 9 is an end view of the exit of the sweep-formin station illustrated in FIG. 7.
Figure 10:
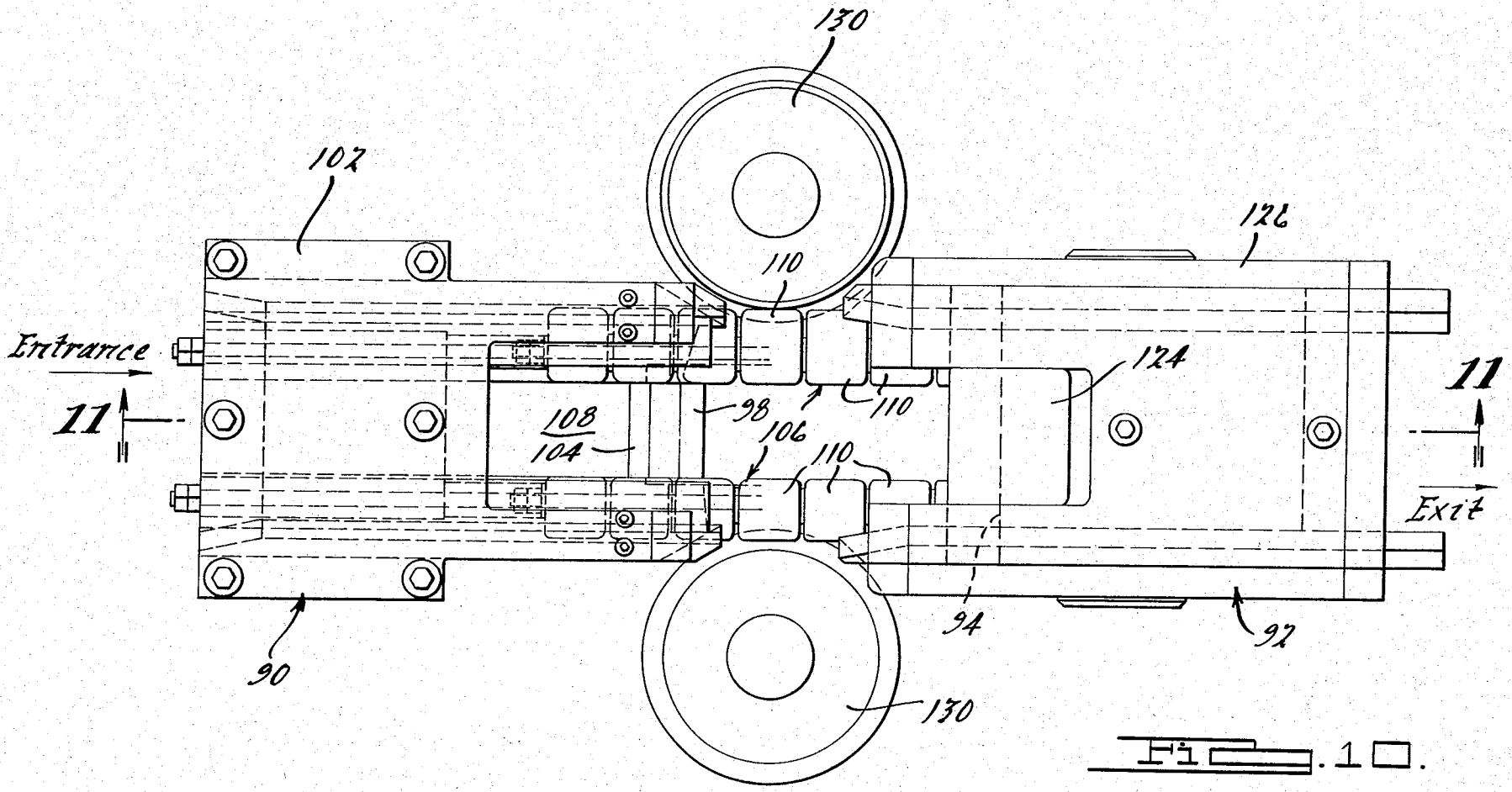
FIG. 10 is a partial top view of the sweep-formin station of FIG. 7, with various components removed fo clarity.
Figure 11:
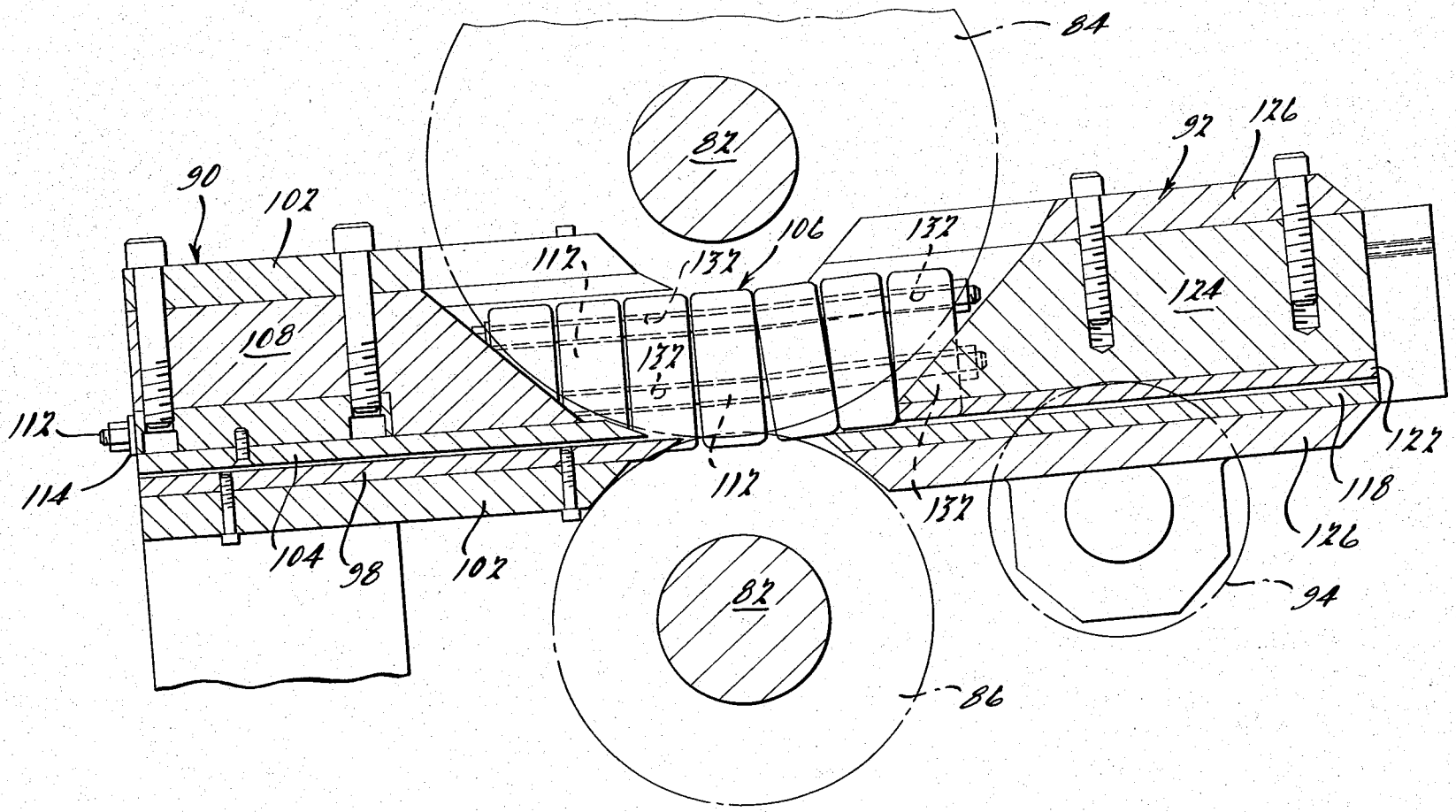
FIG. 11 is a sectional view taken along line 11—11 c FIG. 10.

FIG. 9 illustrates the interaction of the exit-end constraining assembly 92 with the bumper 30 in the exemplary sweep-forming apparatus 22 according to the present invention. Like the constraining assembly 90, the exit-end constraining assembly 92 generally includes a pair of suitably-shaped outside arbors 116 that slidably and conformingly engage the exterior transverse surfaces of the bumper portions 32 and 36, a back-up shoe 118 that slidably and conformingly engages the exterior lateral surfaces of the bumper portion 34, and a pair of constraining arbors 120 that slidably and conformingly engage the exterior lateral surfaces of the bumper flanges 38 and 40. The interior surfaces of the bumper 30 are similarly constrained by the sliding and conforming engagement arbor blocks 110 of the snake arbors 106 and an insert member 122 secured to a guide block 124. The outside arbors 116, and back-up shoe 118, the constraining arbors 120, the insert member 122, and the guide block 124 are all connected to a fixed body portion 126 of the constraining assembly 92.

As the bumper 30 moves longitudinally through the area between the entrance-end constraining assembly 90 and the exit-end constraining assembly 92, it is substantially constrained by the driven forming rolls 84 and 86, a pair of idler rolls 130 and the snake arbors 106. The idler rolls 130 are rotatable about generally transversely-extending axes, and have outer surfaces that conformingly engage the exterior transverse surfaces of the bumper 30. The snake arbors 106 longitudinally extend generally from the exit area of the constraining assembly 90 into the entrance area of the constraining assembly 92. The tie rods 112 extend through longitudinal openings 132 in the individual arbor blocks 110 that are sized to allow a substantial amount of clearance between the tie rods 112 and the openings 132. Thus the individual arbor blocks 110 are allowed to pivot, or articulate, in a transverse direction so that the snake arbors 106 can slidably constrain and conform to the interior of the bumper 30 as the sweep or curvature is introduced therein.

The bumper 30 in the exemplary sweep-forming apparatus 22 is permanently deformed to introduce a sweep therein primarily by the interaction of the forming rolls 84 and 86 and the forming roll 94 at the middle or intermediate sweep-forming station 72. In the exemplary embodiment, the rolls at the first and third sweep-forming stations primarily serve the function of guiding the bumper 30 as it is passed to and from the second or intermediate station. Thus during the forming of the sweep, the longitudinally-moving bumper 30 is substantially constrained over substantially all of its interio and exterior surfaces, both lateral and transverse. Dur ing the development and construction of an actually constructed embodiment of the exemplary sweep-form ing apparatus 22, it was found that by substantiall constraining such surfaces during the sweep-formin operation, the previously-formed cross-sectional shap and configuration of the moving elongated article coul be maintained without the introduction of undesirabl wrinkles, folds or other undesired deformations. Thus the present invention allows an elongated article to b roll-formed to a desired final cross-section, using con ventional and easy-to-control roll-forming techniques and then permanently deformed in a transverse direc tion into a desired swept or curved configuration with out disturbing or damaging the previously-formed arti cle. Furthermore, the present invention may be so em ployed in the forming of high-strength materials, suc as high-strength, low-alloy (HSLA) steels, for example It should be emphasized that although the exemplar sweepforming apparatus 22 includes three serially-dis posed sweep-forming stations, with only the second o middle station including the entrance and exit constrain ing assemblies 90 and 92, the invention is not limited t such a construction. From the foregoing discussion, on skilled in the art will now readily recognize that an number of stations may be employed, and that one o more of such stations may include the constraining assemblies discussed above, in a particular application The exact number of stations and constraining assem blies necessary or desirable in a particular applicatio depends upon factors such as the properties of the mate rial being formed, the cross-sectional configuration o the article being formed, and the desired amount o sweep or curvature, for example.

The foregoing discussion discloses and describes ex emplary embodiments of the present invention. On skilled in the art will readily recognize from such dis cussion that various changes, modifications and varia tions may be made therein without departing from th spirit and scope of the invention as defined in the fol lowing claims.

What is claimed is:

1. An apparatus for introducing a sweep into an elon gated article having a predetermined cross-sectional shape and defining an interior surface and an exterio surface comprising:

first and second pinch roll driving means in rolling engagement with said article for driving said article in a longitudinal direction;

roll-forming means disposed longitudinally subsequent to said first and second pinch roll driving means for introducing a sweep into said elongated article;

constraining means for preventing change in said predetermined cross-sectional shape including, (a) an entrance guide means fixed relative to said first and second driving means and disposed longitudinally precedent to said first and second driving means, said entrance guide means having means for slidingly supporting substantially the entire exterior surface of said article as it enters engagement with said driving means;

(b) an exit guide means fixed relative to said first and second driving means and disposed longitudinally subsequent to said first and second driving means and disposed both longitudinally precedent and subsequent to said roll-forming means, said exit guide means having means for slidingly supporting substantially the entire exterior surface of said article as it exits from engagement with said driving means;

(c) internal supporting means comprising at least two elongated and parallel snake arbor means extending longitudinally between said entrance guide means and said exit guide means and disposed on axially opposite sides of said first pinch roll driving means, said internal supporting means slidingly supporting substantially the entire interior surface of said article as it enters engagement with said driving means and as it exits engagement with said driving means; and (d) means disposed generally between said entrance and exit guide means for supporting said exterior surface of said article as it passes between said entrance and exit guide means.

2. The apparatus according to claim 1 wherein said means for supporting said exterior surface of said article as it passes between said entrance and exit guide means includes at least one idler roll.

3. The apparatus of claim 1 wherein each of said snake arbor means includes a plurality of tie rods extending longitudinally therethrough.

4. The apparatus of claim 1, further comprising a base, a support platform for carrying at least said first and said second pinch roll driving means, and adjustment means for interconnecting said platform with said base.

5. The apparatus of claim 4 wherein said adjustment means comprises means for adjusting the spatial relationship of said platform to said base.

6. The apparatus of claim 4 wherein said adjustment means comprises means for raising and lowering said platform relative to said base.

7. The apparatus according to claim 1 further comprising at least one forming station having third and fourth pinch roll driving means, said forming station disposed longitudinally precedent to said first and second pinch roll driving means.

8. The apparatus of claim 1 further comprising forming station having third and fourth pinch roll driving means, said forming station disposed longitudinally subsequent to said roll-forming means.

9. The apparatus according to claim 1 further comprising a first forming station having third and fourth pinch roll driving means disposed longitudinally precedent to said first and second pinch roll driving means; and second forming station having fifth and sixth pinch roll driving means disposed longitudinally subsequent to said roll-forming means.

10. The apparatus of claim 9 wherein each of said forming stations includes a platform, a base, and adjustment means for connecting said platform to said base.

11. The apparatus of claim 10 wherein said adjustment means are operable to independantly raise and lower said platforms relative to said bases.

* * * * *